United States Patent [19]

Daiguji et al.

[11] Patent Number: 4,557,007

[45] Date of Patent: Dec. 10, 1985

[54] ANCHOR SOCKET

[75] Inventors: Hisashi Daiguji, Toyonaka; Ikuo Tanaka, Itami, both of Japan

[73] Assignees: Harumoto Iron Works Co., Ltd.; Sumitomo Electric Industries, Ltd., both of Osaka, Japan

[21] Appl. No.: 584,785

[22] Filed: Feb. 29, 1984

[30] Foreign Application Priority Data

May 9, 1983 [JP] Japan ..... 58-70249[U]

[51] Int. Cl.[4] ..... E01D 19/10

[52] U.S. Cl. ..... 14/22; 14/21; 24/122.6; 52/230

[58] Field of Search ..... 14/22, 21; 24/122.6; 52/230; 403/275

[56] References Cited

U.S. PATENT DOCUMENTS 3,457,717 7/1969 Durkee et al. ..... 14/22

FOREIGN PATENT DOCUMENTS 646155 9/1962 Italy ..... 52/230

1125176 8/1968 United Kingdom ..... 52/230

*Primary Examiner*—Stephen J. Novosad

*Assistant Examiner*—John F. Letchford

*Attorney, Agent, or Firm*—Ernest A. Beutler

[57] ABSTRACT

An anchor socket for bridge cables having bundles of stranded steel wires. It has a plurality of ribs formed on its inner wall. The larger the inner diameter of the ribs, the smaller the distance from the point where the cables are fastened.

6 Claims, 7 Drawing Figures

ANCHOR SOCKET

The present invention relates to an anchor socket for a bridge cable.

In such a suspension bridge as shown in FIG. 1, each cable 2 for supporting a bridge girder 1 has a plurality of PC (prestressed concrete) steel wires bound together. In order to secure the end of the cables, it has been a common practice to insert the end of the bundle 5 of the PC steel wires into an anchor socket 4 provided with a tapered hole 3 as shown in FIG. 2, to cause the wires to diverge in radial directions within the hole, and to pour molten metal such as zinc into the hole to fasten the wires. A problem with this method is that the high temperature (about 500° to 700° C.) of the molten metal poured into the hole causes a metallographical change in the steel wires, causing a decline in the strength of the cable. Another problem is that the steel wires are fatigued by the outward bending to which they are subjected when the bundle 5 is allowed to diverge in radial directions within the anchor socket 4 and this metal fatigue causes a decline in the strength of the cable.

It is an object of the present invention to solve the above-described problems and to provide an improved anchor socket for cables.

In accordance with the present invention, the anchor socket is formed on its inside with a plurality of annular ribs, the inside diameters of which are the larger, the smaller the distance from the anchored end of the cable.

Due to this arrangement of the annular ribs of the anchor socket, the steel wires are not bent with so large an angle. Therefore, the decrease in their strength due to metal fatigue is eliminated.

Another advantage is that since casting with molten metal is not needed any more, the steel wires are not subjected to any metallographical change due to high temperature.

Other objects and advantages of the present invention will become apparent from the following description taken with reference to the accompanying drawings, in which.

Figure 1:
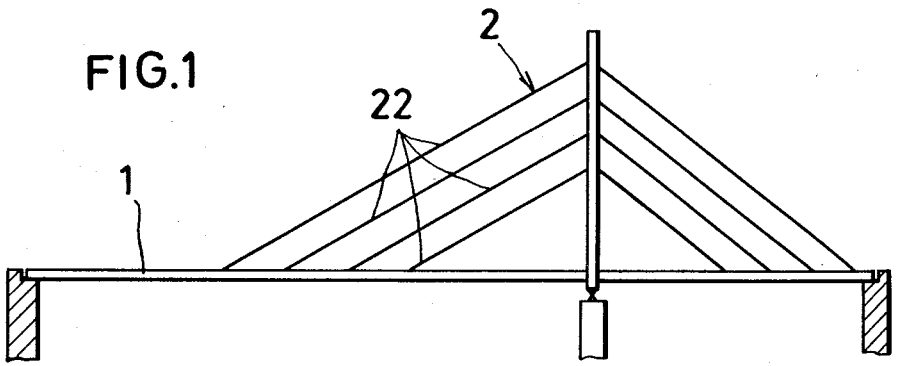
FIG. 1 is a view showing an example of a suspension bridge.
Figure 2:
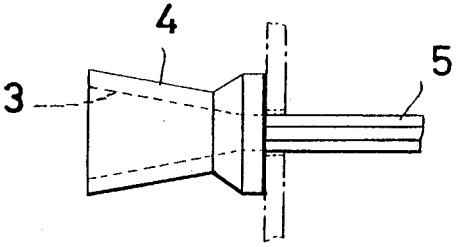
FIG.2 PRIOR ART
FIG. 2 is a front view of a conventional anchor socket.
Figure 3:
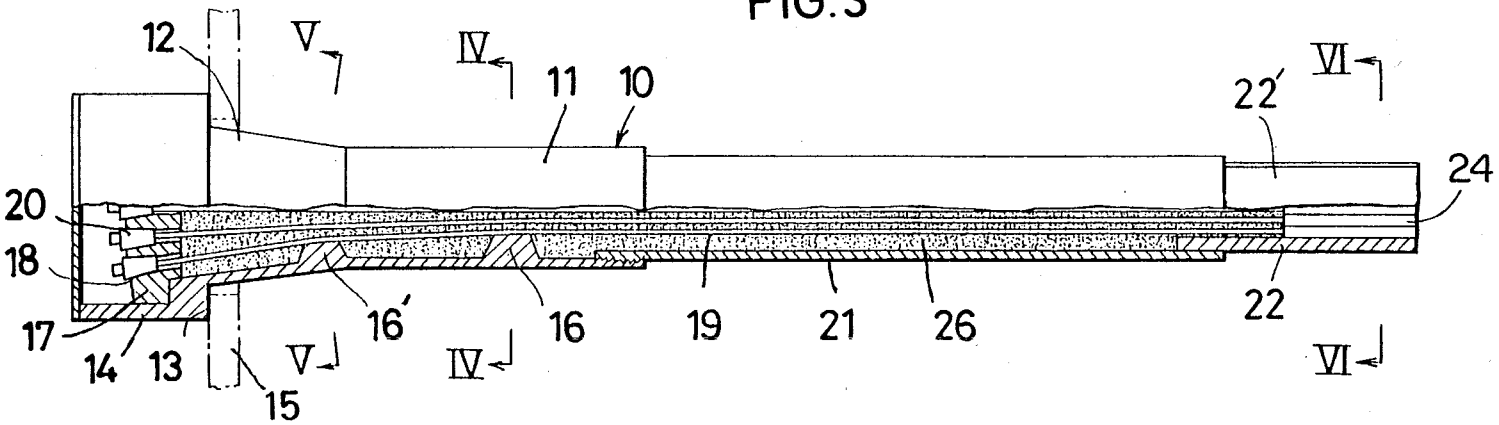
FIG. 3 is a sectional view showing the anchor socket of this invention in use.

Referring to FIG. 3, the anchor socket 10 in accordance with the present invention comprises a cylindrical portion 11, a conical portion 12 extending from one end of the cylindrical portion 11, and a base portion 14 provided with an annular shoulder 13. The shoulder is adapted to be secured to a member 15 integral with the bridge girder.

Figure 4:
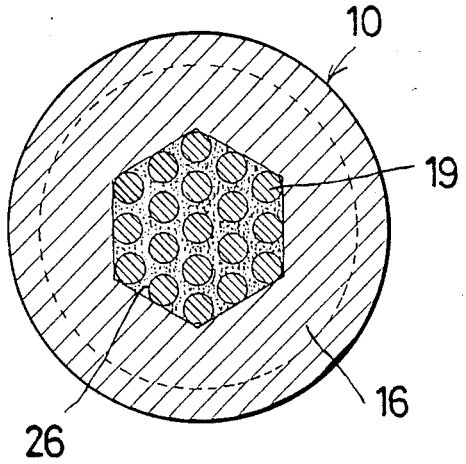
FIG. 4 is an enlarged sectional view taken along lines IV—IV of FIG. 3.
Figure 5:
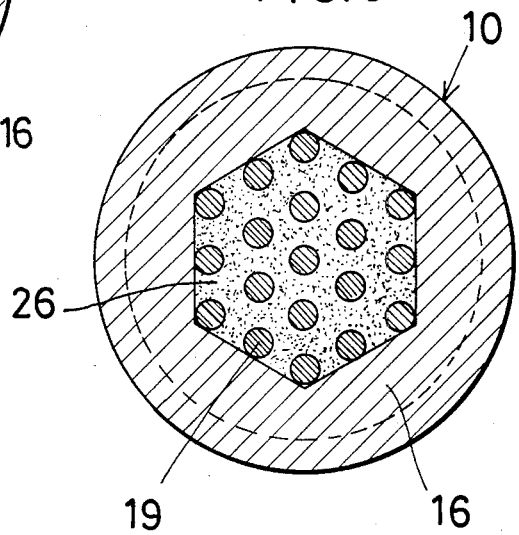
FIG. 5 is an enlarged sectional view taken along the lines V—V of FIG. 3.
Figure 6:
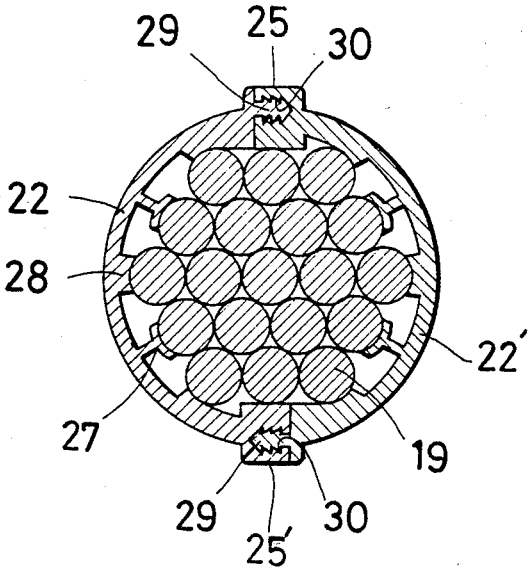
FIG. 6 is an enlarged sectional view taken along the lines VI—VI of FIG. 3.

The cylindrical portion 11 and the conical portion 12 are formed with ribs 16 and 16', respectively. As shown in FIGS. 4 and 5, the internal periphery of the ribs 16 and 16' are hexagonal and the inside diameter of the rib 16' (i.e., the diameter of a circle inscribed therein) provided in the conical portion 12 is larger than that of the rib 16 provided in the cylindrical portion 11. The internal periphery of the ribs 16 and 16' may be of any other polygonal shape or circular.

Figure 7:
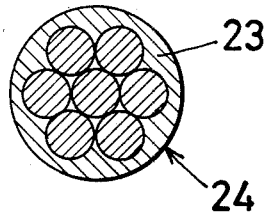
FIG. 7 is an enlarged sectional view of PC steel stranded wires of an unbonded type.

A stop plate 17 provided with a plurality of holes 18 is secured in the base portion 14 of the anchor socket 10. A tapered grip 20 secured to the end of each steel wire 19 is inserted and held in each hole 18. A coupling sleeve 21 is connected to the end of the cylindrical portion 11 of the anchor socket 10 by screwing it thereinto. Cable covers 22 and 22' are inserted into the other end of the coupling sleeve 21. The cable covers of a semicircular shape are applied to the bundle 24 of unbonded type stranded PC steel wires covered with a polyethylene sheath 23 (FIG. 7) and are coupled together at mating portions 25 and 25'.

The polyethylene sheath 23 is peeled off the portion of the PC steel wire 19 which is to be positioned within the coupling sleeve 21 and the anchor socket 10, so that the stranded PC steel wires 19 are exposed. The interior of the coupling sleeve 21 and the anchor socket 10 is filled up with grout 26.

The cable covers 22, 22' are formed on their inside with a plurality of ribs 27 and stands 28 spaced therebetween to incorporate the wires 19 tightly within the cable covers without the need of any spacer. Each cable cover has a projection 29 at one edge and a recess 30 at the other edge, the projection being adapted to be received in the recess. The projection and recess have a rugged surface to prevent them from getting off from each other.

Since the steel wires 19 are brought toward each other by the ribs 16, 16', undue stress is not applied to the cable covers 22, 22'.

What are claimed are:

1. An anchor socket for bridge cables having bundles of stranded steel wires, means for fastening said cables longitudinally to said anchor socket in spaced relationship, said anchor socket having a first series of ribs formed on the inner wall thereof and a second series of ribs spaced a greater longitudinal distance from said fastening means than said first series of ribs, said first series of ribs having a larger inner diameter than said second series of ribs, said ribs being adapted to engage the radial outermost of said wires for effecting a curvature thereof with said wires being free of engagement with said ribs in the longitudinal area between said ribs.

2. The anchor socket as claimed in claim 1 wherein said stranded steel wires are covered with plastics for rustproofness.

3. The anchor socket as claimed in claim 1, wherein the fastening means comprises a stop plate formed with a plurality of holes for receiving and affixing the ends of cables therein, a conical portion connected to said stop plate, and a cylindrical portion connected to said conical portion at the end opposite to said stop plate, said first series of ribs being formed on the inner wall of said conical portion and said second series of ribs being formed on said cylindrical portion.

4. The anchor socket as claimed in claim 1, wherein the first and second series of ribs are each formed by polygonal shaped openings.

5. The anchor socket as claimed in claim 3, wherein the first and second series of ribs are formed by respective polygonal shaped openings formed in the conical portion and the cylindrical portion.

6. The anchor socket as claimed in claim 5, further including a grout filling the area between the stop plate and the outer end of the cylindrical portion and encompassing the individual wires.

* * * * *